US006588837B1

(12) United States Patent
Schultz et al.

(10) Patent No.: US 6,588,837 B1
(45) Date of Patent: Jul. 8, 2003

(54) CHAIR WITH PULL OUT SLEEP SURFACE

(75) Inventors: Scott A. Schultz, Batesville, IN (US); G. Brent Fagan, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/704,075

(22) Filed: Nov. 1, 2000

(51) Int. Cl.[7] ..... A47C 17/04

(52) U.S. Cl. ..... 297/111; 297/118; 297/188.09; 297/378.1; 5/18.1; 5/21; 5/58

(58) Field of Search ..... 297/111, 124, 297/125, 126, 118, 236, 370.1, 188.09, 188.1, 378.1; 5/17, 9.1, 18.1, 21, 47, 58, 45

(56) References Cited

U.S. PATENT DOCUMENTS

| | | | | | |
|---|---|---|---|---|---|
| 2,247,546 | A | * | 7/1941 | Donoho | 297/111 |
| 2,663,354 | A | * | 12/1953 | Bell | 297/111 |
| 2,691,175 | A | * | 10/1954 | Brahm et al. | 5/53.1 |
| 2,775,996 | A | * | 1/1957 | Millar | 297/62 |
| 4,099,275 | A | * | 7/1978 | Pallan | 5/18 |
| 4,402,096 | A | * | 9/1983 | Atimichuk | 5/17 |
| 4,672,696 | A | * | 6/1987 | Horenkamp | 5/17 |
| 4,690,358 | A | | 9/1987 | Horenkamp | |
| 4,860,393 | A | * | 8/1989 | Schefthaler | 5/14 |
| 5,015,031 | A | | 5/1991 | Horenkamp | |
| 5,979,977 | A | | 11/1999 | Lusch | |

OTHER PUBLICATIONS

Brandrud Furniture, Inc. Slumber ™ brochure, 4 pages.
Page 28 from 1997–1998 Lusche Catalog.

* cited by examiner

*Primary Examiner*—Peter M. Cuomo
*Assistant Examiner*—Stephanie Harris
(74) *Attorney, Agent, or Firm*—Barnes & Thornburg

(57) ABSTRACT

A chair is adapted to form a sitting surface and a sleeping surface and comprises a chair back and a seat. The chair back and seat are relatively movable to form the sitting surface and the sleeping surface.

In the event that there are any questions related to this amendment or to the application in general, the undersigned would appreciate the opportunity to address those questions directly in a telephone interview to expedite the prosecution of this application for all concerned.

48 Claims, 3 Drawing Sheets

CHAIR WITH PULL OUT SLEEP SURFACE

FIELD OF THE INVENTION

The present invention relates to a chair, particularly to a chair which converts into a sleeping surface.

BACKGROUND OF THE INVENTION

Chairs which recline are often used in clinics and/or hospitals, to permit family to stay with loved ones. It is desirable to have a chair which will convert to a substantially horizontal sleeping surface, and then retract back to and only take the space of a chair. Accordingly, a chair with a sleeping surface is provided.

Other chairs which form sleeping surfaces have been used. There is, for example, the system illustrated and described in U.S. Pat. No. 4,672,696 to F. Horenkamp, entitled, "Convertible Sitting/Reclining Furniture Article", issued Jun. 16, 1987, the disclosure of which is hereby expressly incorporated herein by reference.

SUMMARY OF THE INVENTION

Accordingly, a chair adapted to form a sitting surface and a sleeping surface is provided. The chair has a frame, and a chair back and seat are coupled to the frame. The chair back is movable from a generally upright back-supporting position to a generally horizontal position, while the seat is movable away from the chair back. When the chair back is moved to the generally horizontally position, the chair back and the seat are positioned in alignment and cooperate to form a generally horizontal sleeping surface.

In an illustrative embodiment, a chair adapted to form a sleeping surface is provided with a frame. A chair back and a seat are coupled to the frame, the seat being movable away from the chair back. The chair back is movable to a generally horizontal position to cooperate with the seat to provide a sleeping surface.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The invention may be best understood by referring to the following detailed description and accompanying drawings which illustrate the invention. In the drawings.

DETAILED DESCRIPTION OF AN ILLUSTRATIVE EMBODIMENT

Figure 1:
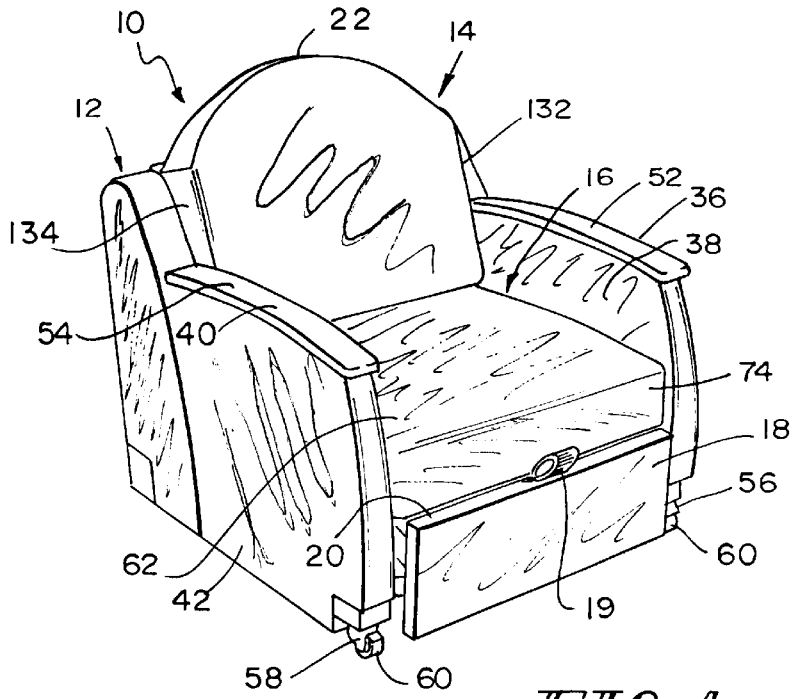
FIG. 1 is a perspective view of a chair which has a pull out portion which converts to a sleeping surface, constructed in accordance with the present invention.

Chair 10 comprises a frame 12 having a pull out portion 13 movable into a generally horizontal sleeping surface. A chair back 14 and a chair seat 16 are coupled to frame 12. Chair seat 16 has a pull out panel 18 having a loop 19 connected to an upper side 20 used to move pull out panel 18 away from chair back 14 so that chair 10 is positioned to form the sleeping surface.

Figure 2:
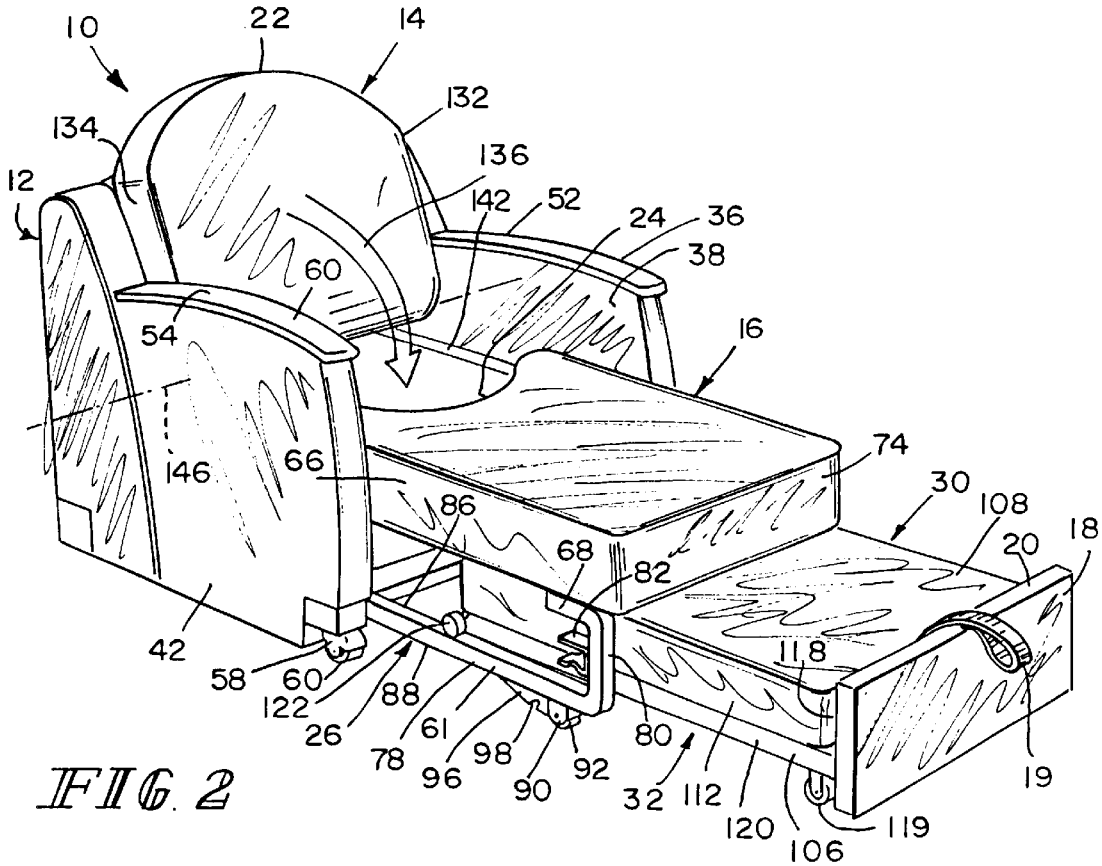
FIG. 2 illustrates a perspective view of the chair of FIG. 1, but showing the pull out portion moved away from a chair back.
Figure 6:
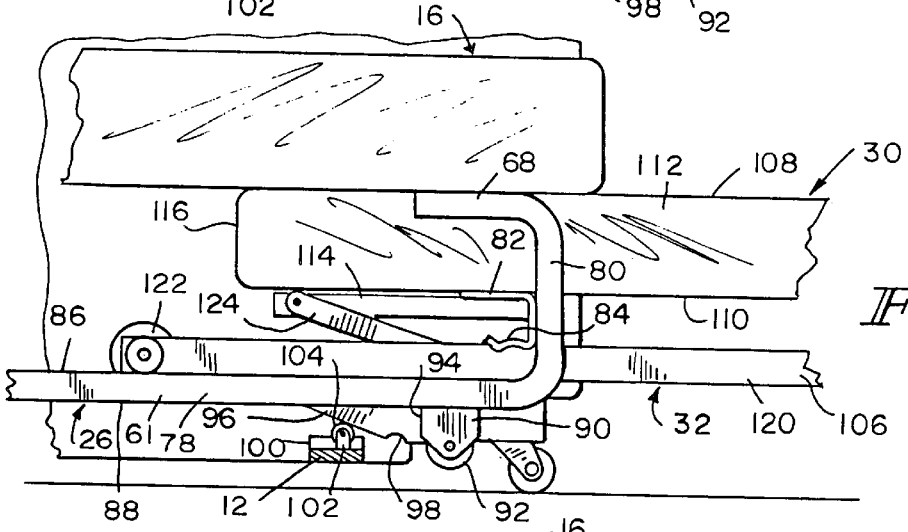
FIG. 6 is a partial side elevation view of the chair of FIG. 2, showing the chair seat and showing the leg support and lower bed assembly moving under the chair seat.

Chair back 14 includes an upper end 22 having a convex shape which is adapted to conformingly fit with a concave rear side 24 of chair seat 16 when chair seat 16 is moved away from chair back 14 and chair back 14 is positioned to form a generally horizontal sleeping surface. Chair seat 16 forms a portion of middle bed assembly 26 when pull out panel 18 is moved away from chair back 14, as shown in FIGS. 2 and 6. Pull out portion 13 includes chair seat 16 and middle bed assembly 26 as well as leg support 30, which forms a portion of lower bed assembly 32 which is coupled to middle bed assembly 26.

Figure 3:
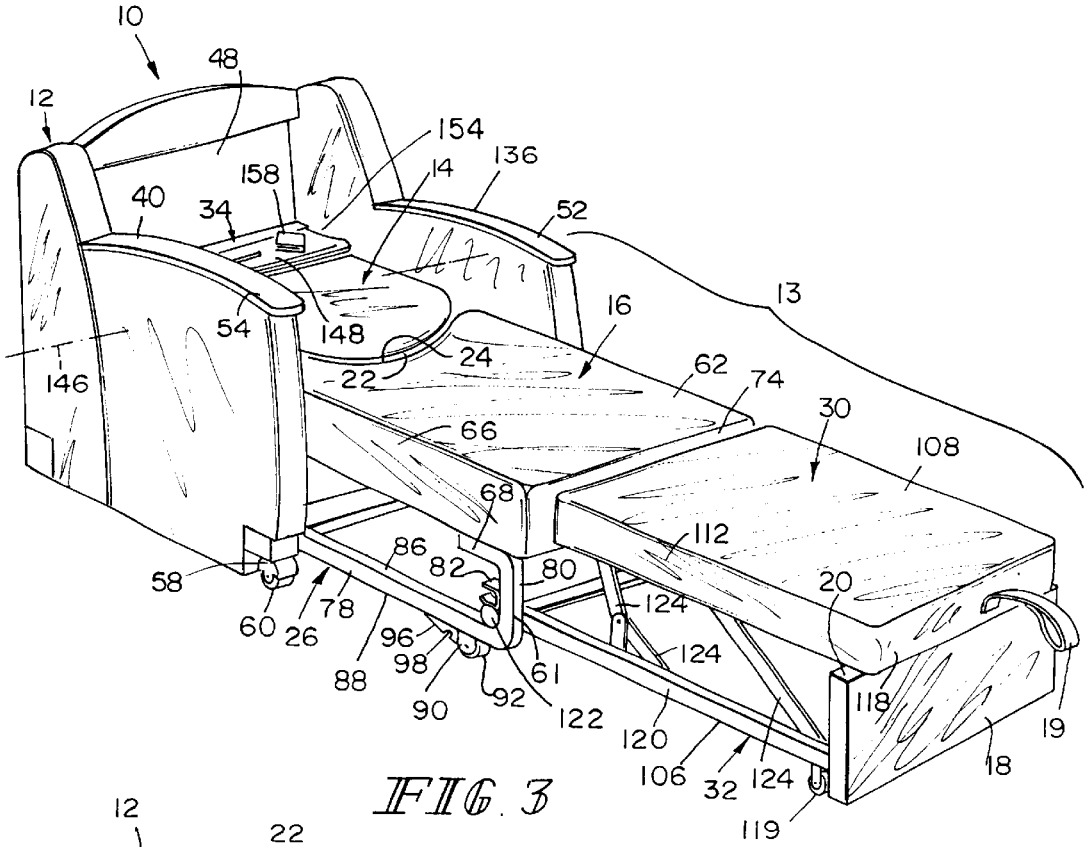
FIG. 3 is a perspective view showing the chair of FIGS. 1 and 2, but showing the chair back moved to a generally horizontal position abutting a chair seat and a leg support moved into a generally horizontal position against the chair seat.
Figure 7:
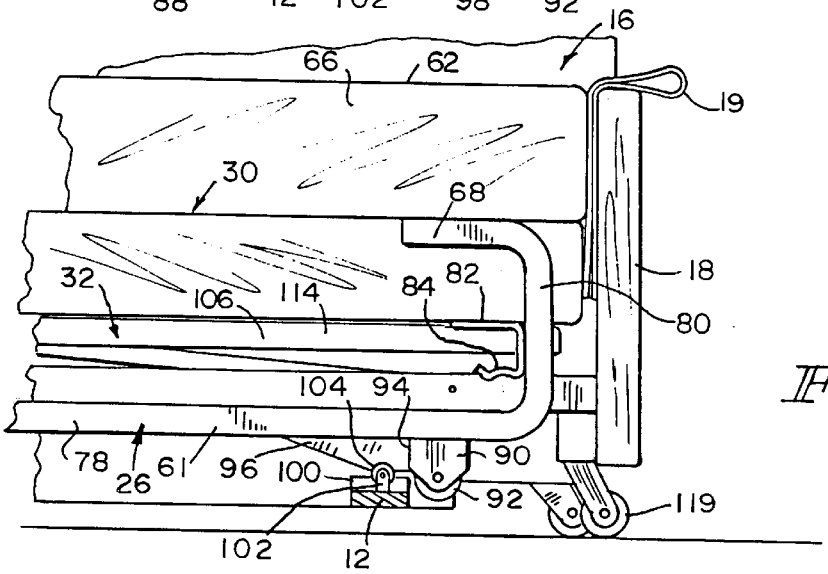
FIG. 7 is a partial side elevation view of the chair of FIG. 1, showing the chair in a retracted position with the leg support and lower bed assembly positioned under the chair seat and locked into a retracted position to form a sitting surface.

Leg support 30 is positioned under chair seat 16 when chair 10 is in a retracted sitting position, and is moved from its position underneath chair seat 16, as shown in FIG. 7, when pull out panel 18 is moved away from chair back 14. Leg support 30 moves to its fully extended position abutting and aligned generally horizontally with chair seat 16, and, along with chair back 14, cooperates to form the generally horizontal sleeping surface, as shown in FIG. 3.

Figure 5:
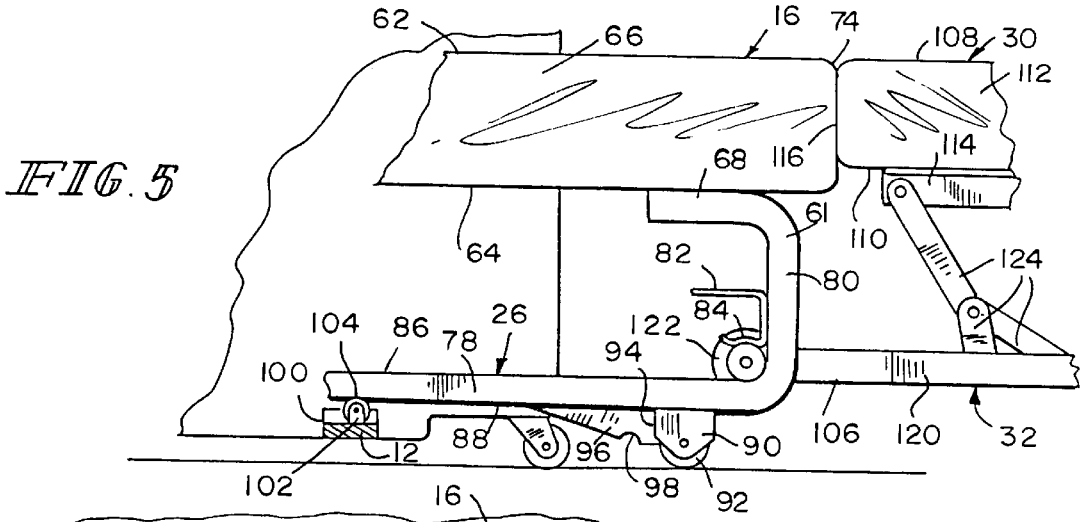
FIG. 5 is a partial side elevation view of the chair of FIG. 3.

In a fully extended position, lower bed assembly 32 is releasably locked to middle bed assembly 26 to hold lower bed assembly 32 in the fully extended position for use as a sleeping surface, as shown in FIG. 5. In addition, middle bed assembly 26 is releasably locked to a portion of frame 12 to hold both middle bed assembly 26 and lower bed assembly 32 in a retracted position forming a sitting surface, as shown in FIG. 7.

Figure 4:
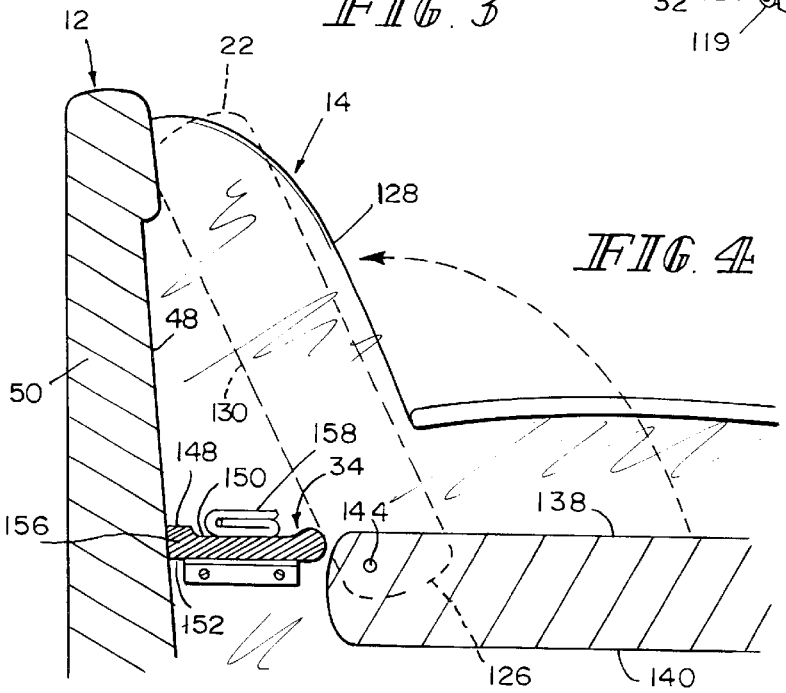
FIG. 4 is a partial side elevation sectional view of the chair of FIGS. 1 to 3, showing the chair back being moved between an upright position and a generally lowered, horizontal position.

A shelf 34 is also coupled to frame 12, and provides a surface on which to dispose items, as shown in FIG. 4. Shelf 34 is hidden when chair back 14 is moved from a position forming a sleeping surface to its upright position.

Frame 12 of chair 10 includes a left side 36 having an inner sidewall 38 and an outer sidewall (not shown), as shown in FIGS. 1 to 4. Frame 12 also has a right side 40 having an inner side wall (not shown) and an outer side wall 42. Left side 36 and right side 40 of frame 12 are coupled to a back support surface 48 having a back frame 50 which supports chair back 14 when chair back 14 is positioned in an upright position. Left and right sides 36, 40 include left and right arm rests 52, 54 and a pair of roller frames 56, 58, each coupled to one of left and right sides 36, 40 and each roller frame 56, 58 having a roller 60. Frame 12 also includes middle bed assembly 26 coupled thereto which supports chair seat 16 and lower bed assembly 32 which is coupled to middle bed assembly 26 and which supports leg support 30.

Turning to middle bed assembly 26, as shown in FIGS. 2–7, middle bed assembly 26 includes both a generally horizontally positioned chair seat 16 and middle bed support frame 61 positioned below chair seat 16. Chair seat 16 includes an upper side 62, a lower side 64 and an outer perimeter 66. Lower side 64 of chair seat 16 is positioned on an upper portion 68 of middle bed support frame 61, which moves chair seat 16 into a position forming a sitting surface and a position forming a sleeping surface, both of which will be described in detail below. Chair seat 16 further includes a rear side 24 positioned under chair back 14 when chair back 14 is in an upright position, and a front side 74. Rear side 24 has a concave shape and is adapted to conformingly fit with an upper end 22 of chair back 14 having a convex shape, when chair seat 16 is moved away from chair back 14, and chair back 14 is lowered to a generally horizontal position such that upper end 22 abuts and aligns with rear side 24 of chair seat 16. It is within the scope of this disclosure that the rear side 24 of chair seat 16 and the upper end 22 of chair back 14 may include other shapes, so long as rear side 24 and upper end 22 align in a general horizontal alignment to form a sleeping surface.

Middle bed support frame 61 also includes a lower portion 78 and a front portion 80. A roller connector 82 is positioned at a junction of front portion 80 and lower portion 78 of middle bed support frame 61, and cooperates therewith to form roller lock 84. Lower portion 78 is movably coupled to frame 12 and includes an upper side 86 and a lower side 88. Lower side 88 includes a roller frame 90 containing a roller 92. Roller frame 90 has a back side 94, and chair seat lock 96 is positioned near back side 94 of roller frame 90 on lower side 88 of middle bed support frame 61. Chair seat lock 96 includes a semi-circular detent 98. Chair seat lock 96 locks middle bed assembly 26, including lower bed assembly 32 positioned underneath chair seat 16 to chair seat retainer 100 thereby positioning middle bed assembly 26 and lower bed assembly 32 in a retracted position forming a sitting surface, as shown in FIGS. 5–7.

Chair seat retainer 100 is connected to frame 12 and includes a roller frame 102 having a roller 104 coupled thereto. Roller 104 of chair seat retainer 100 rolls on lower side 88 of lower portion 78 of middle bed support frame 61. When roller 104 of chair seat retainer 100 is rolled into detent 98 of chair seat lock 96, as shown in FIG. 7, middle bed support frame 61 of middle bed assembly 26 and lower bed assembly 32 are positioned underneath chair seat 16 in a retracted position forming a sitting surface, as shown in FIG. 1. When loop 19 of pull out panel 18 is pulled away from chair 10, roller 104 of chair seat retainer 100 is rolled off of detent 98 of chair seat lock 96 and chair seat 16 including middle bed assembly 26 and lower bed assembly 32 are released from the retracted locked position and are moved away from chair back 14 to form a sleeping surface, as shown in FIGS. 2, 3 and 5.

Lower bed assembly 32 includes leg support 30, pull out panel 18 and lower bed support frame 106. Leg support 30 includes an upper side 108, a lower side 110, and an outer perimeter 112. Lower side 110 of leg support 30 is positioned to lie on an upper portion 114 of lower bed support frame 106, and leg support 30 includes a first end 116 which abuts a portion of chair seat 16 when lower bed assembly 32 is positioned to form a sleeping surface, and a second end 118 which abuts pull out panel 18.

Lower bed support frame 106 is coupled to pull out panel 18 which has a pair of rollers 119 thereon to support movement of pull out panel 18, only one roller 119 shown in FIGS. 2 to 3 and 7. Lower bed support frame 106 includes a lower portion 120 coupled to a pair of rollers 122 (only one roller being shown in FIGS. 2 to 3 and 5 to 6). Rollers 122 are positioned to roll on upper side 86 of lower portion 78 of middle bed support frame 61, coupling lower bed assembly 32 to middle bed assembly 26. Lower portion 120 of lower bed support frame 106 rolls on and movably positions lower bed assembly 32 in a fully extended position and in a retracted position adjacent upper portion 68 and lower portion 78 of middle bed support frame 61 and below chair seat 16.

A plurality of support members 124 connect upper portion 114 of lower bed support frame 106 to lower portion 120. Support members 124 operate to move leg support 30 and lower bed support frame 106 into a retracted positioned to move under chair seat 16 when middle bed assembly 26 and lower bed assembly 32 are positioned to form a sitting surface. Conversely, support members 124 also operate to move leg support 30 upwardly into a horizontally aligned position against chair seat 16 of middle bed assembly 26 when chair seat 16 is moved away from chair back 14 in a position forming a sleeping surface. That is, when leg support 30 is moved into a generally horizontal alignment with chair seat 16, first end 116 of leg support 30 is positioned against front side 74 of chair seat 16 and second end 118 of leg support 30 is positioned over upper side 20 of pull out panel 18, as shown in FIG. 3. Lower bed assembly 32 and leg support 30 and middle bed assembly 26 and chair seat 16 are moved into a sleeping surface by apparatus taught in U.S. Pat. No. 4,672,696 to Horenkamp entitled Convertible Sitting/Reclining Furniture Article issued Jun. 16, 1987, which has.previously been incorporated by reference herein.

Chair back 14 is movable between a generally upright position and a lowered position. Chair back 14 in its upright position includes upper end 22 having a convex shape, a lower end 126, a front side 128, a back side 130, and left and right sides 132, 134. When chair back 14 is lowered in a downward direction 136 to lie in a generally horizontal position, as shown in FIGS. 3 to 4, back side 130,becomes an upper surface 138 and front side 128 becomes a lower surface 140 which is positioned against support member 142 which is exposed when chair seat 16 is moved in a forwardly direction away from chair back 14. Upper end 22 of chair back 14 abuts rear side 24 of chair seat 16 to align with and form a generally horizontal sleeping surface.

Left and right sides 132, 134 of chair back 14 are pivotably coupled to left and right sides 36, 40 of frame 12 by bar 144 connected to frame 12 and positioned through at least a portion of lower end 126 of chair back 14, as shown in FIG. 4. Bar 144 forms a pivot axis 146 upon which chair back 14 pivotably moves, from an upright position to a lowered, generally horizontal position, as shown in FIGS. 2–4. It is within the scope of this disclosure that chair back 14 is not pivotably coupled to frame 12 of chair 10, and is manually positioned to against chair seat 16 and aligned with chair seat 16 to form a generally horizontal sleeping surface.

Shelf 34 is positioned between back support surface 48 and back side 130 of chair back 14 when chair back 14 is in an upright position. Shelf 34 has an upper side 148 having a recessed area 150 and a lower side 152. Shelf 34 also has left and right ends 154, 156. Shelf 34 is connected to back support surface 48 and/or left and right sides 36, 40 of frame 12.

Upper side 148 of shelf 34 is configured to receive items, such as, for example, wallet 158. It is within the scope of this disclosure that any item or combination of items may be disposed upon upper side 148 of shelf 34. When chair back 14 is positioned in an upright position consistent with a retracted position forming a sitting surface, as shown in FIGS. 1 and 4, shelf 34 and wallet 158 positioned thereon are hidden from view.

When loop 19 of pull out panel 18 is pulled (FIGS. 2 and 6), lower bed assembly 32 moves out from its retracted position under chair seat 16 and chair seat 16 including middle bed assembly 26 moves away from chair back 14. In addition, roller 104 in roller frame 102 of chair seat retainer 100 is moved off its locked position on detent 98 of chair seat lock 96 and rolls on lower portion 78 of middle bed support frame 61 away from chair back 14. When lower bed assembly 32 and middle bed assembly 26 are in a fully extended position, as shown in FIG. 3, leg support 30 of lower bed assembly 32 is positioned to abut and align horizontally with chair seat 16 of middle bed assembly 26. Lower bed assembly 32 is locked in the fully extended position by coupling of roller 122 connected to lower portion 78 of lower bed support frame 106 to roller lock 84 of roller connector 82 of middle bed support frame 61, which releasably clamps roller 122 in a locked position.

Chair back 14 is then lowered to a generally horizontal position on support member 142. In this position, upper end 22 of chair back 14 abuts and is generally horizontally aligned with rear side 24 of chair seat 16. Shelf 34 is exposed and items such as wallet 158 are visible and accessible. Chair back 14, chair seat 16 supported by middle bed assembly 26, and leg support 30 supported by lower bed assembly 32 cooperate to form a generally horizontal sleeping surface, similar to a standard generally horizontally disposed mattress for a bed (not shown).

When chair 10 is moved from the fully extended position forming a generally horizontal sleeping surface to a retracted position, upper end 22 of chair back 14 is moved to a generally upright position, thereby hiding shelf 34. Leg support 30 of lower bed assembly 32 is pushed downward while pull out panel 18 is pushed toward chair back 14. Roller 122 connected to lower portion 78 of lower bed support frame 106 is rolled out of roller lock 84 of roller connector 82 of middle bed support frame 61, and lower bed assembly 32 including leg support 30 moves underneath chair seat 16 and is positioned thereunder. Roller 104 of chair seat retainer 100 positioned on lower side 88 of lower portion 78 of middle bed support frame 61 is rolled into detent 98 of chair seat lock 96 positioned on frame 12 to releaseably couple middle bed assembly 26 and lower bed assembly 32 positioned below chair seat 16 in a retracted position forming a sitting surface.

Although the invention has been described in detail with reference to certain preferred embodiments, variations and modifications exist within the scope and spirit of the invention is described and defined in the following claims.

What is claimed is:

1. A chair adapted to form a sitting surface and a sleeping surface comprising a frame, a chair back coupled to the frame and movable from a generally upright back-supporting position to a generally horizontal position, and a seat coupled to the frame and movable away from the chair back so that when the chair back is moved to the generally horizontal position, the chair back and the seat are positioned in alignment and cooperate to form a generally horizontal sleeping surface, wherein the chair back in the upright back-supporting position has a convex upper end and an end of the seat positioned under the chair back has a concave end, the convex upper end of the chair back movable to a generally horizontal position to both align and conformingly fit the concave end of the seat when the seat is moved away from the chair back to form a portion of the generally horizontal sleeping surface.

2. The chair of claim 1 wherein the chair includes a lock coupled below the seat to the frame to releasably lock the seat adjacent the chair back to provide a sitting surface.

3. The chair of claim 2 wherein the lock is connected to a support frame below the seat, the lock including a ramp with a detent formed therein, the frame including a retainer having a roller which is releasably retained in the detent when the chair is in a locked position forming the sitting position.

4. A chair adapted to form a sleeping surface comprising a frame, a chair back coupled to the frame, and a seat coupled to the frame, the seat being movable away from the chair back, the chair back being movable to a generally horizontal position to cooperate with the seat to provide a sleeping surface, wherein the chair back in a generally upright position has a convex upper end and an end of the seat positioned under the chair back has a concave end, the convex upper end of the chair back movable to a generally horizontal position to both align and conformingly fit the concave end of the seat when the seat is moved away from the chair back.

5. The chair of claim 4, wherein the chair back is mounted to the frame permitting the chair back to pivotably move to its generally upright and generally horizontal positions.

6. The chair of claim 4 wherein the chair includes a lock coupled below the seat to the frame to releasably lock the seat adjacent the chair back to provide a sitting surface.

7. The chair of claim 6 wherein the lock is connected to a support frame below the seat, the lock including a ramp with a detent formed therein, the frame including a retainer having a roller which is releasably retained in the detent when the chair is in a locked position forming the sitting position.

8. A chair adapted to form both a sitting surface and a sleeping surface comprising a frame, a chair back coupled to the frame and having an upright position and movable to a lowered position, and a seat coupled to the frame to cooperate with the chair back to provide a sitting surface in front of the chair back when the chair back is in the generally upright position, the seat being movable forwardly to cooperate with the chair back moved into the lowered position to form a sleeping surface, wherein the chair back in its upright position has a convex upper end and an end of the seat positioned under the chair back has a concave end, the convex upper end of the chair back movable to the lowered position to both align and conformingly fit the concave end of the seat when the seat is moved away from the chair back.

9. The chair of claim 8, wherein the chair back is mounted to the frame permitting the chair back to pivotably move to its upright and lowered positions.

10. The chair of claim 8 wherein the chair includes a lock coupled below the seat to the frame to releasably lock the seat adjacent the chair back to provide a sitting surface.

11. The chair of claim 10 wherein the lock is connected to a support frame below the seat, the lock including a ramp with a detent formed therein, the frame including a retainer having a roller which is releasably retained in the detent when the chair is in a locked position forming the sitting position.

12. A chair adapted to form a sitting surface and a sleeping surface comprising a frame, a chair back coupled to the frame and movable between generally upright and generally horizontal positions, the chair back including in its generally upright position a bottom end, a seat coupled to the frame and movable away from the bottom end of the chair back during transition of the chair from providing a sitting surface to providing a generally horizontal sleeping surface, and a leg support coupled to the frame and positioned underneath the seat and movable out from under the seat when the seat is moved away from the bottom end of the chair back, the chair back moved from the generally upright position to the generally horizontal position, and the chair back, the seat and the leg support positioned in alignment and cooperating to form the generally horizontal sleeping surface with the chair back abutting the seat and the seat abutting the leg support.

13. The chair of claim 12 wherein the chair includes a lock coupled to a support frame and the frame to releaseably lock the seat adjacent the chair back to provide a sitting surface.

14. The chair of claim 13 wherein the lock includes a ramp with a detent formed therein, the frame including a retainer having a roller which is releasably retained in the detent when the chair is in a locked position forming the sitting position.

15. A chair adapted to form a sitting surface and a sleeping surface comprising a frame, a chair back coupled to the frame and movable between generally upright and generally horizontal positions, a seat coupled the frame and movable away from the chair back, and a leg support coupled to the frame and positioned underneath the seat and movable out from under the seat when the seat is moved away from the chair back, the chair back moved form a generally upright position to a generally horizontal position, and the chair back, the seat and the leg support positioned in alignment and cooperating to form a generally horizontal sleeping surface with the chair back abutting the seat and the seat abutting, the leg support, wherein the chair back in its upright position has a convex upper end and an end of the seat positioned under the chair back has a concave end, the convex upper end of the chair back moved to the generally horizontal position to both align and conformingly fit the concave end of the seat when the seat is moved away from the chair back.

16. The chair of claim 15, wherein the chair back is mounted to the frame permitting the chair back to pivotably move to its generally upright and generally horizontal positions.

17. The chair of claim 15 wherein the chair includes a lock coupled below the seat to the frame to releasably lock the seat adjacent the chair back to provide a sitting surface.

18. The chair of claim 17 wherein the lock is connected to a support frame below the seat, the lock including a ramp with a detent formed therein, the frame including a retainer having a roller which is releasably retained in the detent when the chair is in a locked position forming the sitting position.

19. A chair adapted to form a sleeping surface comprising a frame, a chair back positioned in an upright position having a convex upper end and coupled to the frame, and a seat having a concave end positioned under the chair back and coupled to the frame, the seat being movable away from the chair back and the chair back being movable to a generally horizontal position such that the convex upper end conformingly fits against the concave end of the seat to cooperate with the seat to provide a sleeping surface.

20. The chair of claim 19, wherein the seat includes a middle bed assembly positioned beneath the seat and a lower bed assembly is positioned underneath the seat when the chair is positioned to form a sitting surface, the lower bed assembly being coupled to the middle bed assembly and movable away from the seat and the chair back, the lower bed assembly including a leg support movable upwardly when the lower bed assembly moves away from the seat such that the leg support is moved into an alignment with the seat of the middle bed assembly to form a portion of the sleeping surface.

21. The chair of claim 20, wherein the chair back abuts the seat and the seat abuts the leg support to form the sleeping surface.

22. The chair of claim 19, wherein a shelf is positioned behind the chair back such that the shelf is hidden when the chair back is in a generally upright position and the shelf is visible and accessible when the chair back is in a generally horizontal position.

23. The chair of claim 19, wherein the chair back is mounted to the frame permitting the chair back to pivotably move between generally upright and generally horizontal positions.

24. The chair of claim 19 wherein the chair includes a lock coupled to a support frame and the frame to releaseably lock the seat adjacent the chair back to provide a sitting surface.

25. The chair of claim 24 wherein the lock includes a ramp with a detent formed therein, the frame including a retainer having a roller which is releasably retained in the detent when the chair is in a locked position forming the sitting position.

26. A chair adapted to form a sitting surface and a sleeping surface comprising a frame, a chair back coupled to the frame and movable from a generally upright back-supporting position to a generally horizontal position, the chair back including a surface against which a back of a person can rest when the chair back is positioned in the generally upright back-supporting position, the surface facing downwardly when the chair back is positioned in the generally horizontal position, and a seat coupled to the frame and movable away from the chair back so that the chair back and the seat are positioned in alignment and cooperate to form a generally horizontal sleeping surface when the chair back is moved to the generally horizontal position, wherein the chair includes a lock coupled below the seat to the frame to releasably lock the seat adjacent the chair back to provide a sitting surface, and the lock is connected to a support frame below the seat, the lock including a ramp with a detent formed therein, the frame including a retainer having a roller which is releasably retained in the detent when the chair is in a locked position forming the sitting position.

27. The chair of claim 26, wherein the support frame supports the seat and is configured to move relative to the frame between a retracted position for the chair to provide the sitting surface and an extended position for the chair to provide the sleeping surface, and the ramp is coupled to the support frame for movement therewith.

28. The chair of claim 26, wherein the seat includes a middle bed assembly positioned underneath the seat and a lower bed assembly positioned underneath the seat when the em chair is positioned to form a sitting surface, the lower bed assembly being coupled to the middle bed assembly and movable away from the seat and the chair back, the lower bed assembly including a leg support movable upwardly when the lower bed assembly moves away from the seat such that the leg support is moved into alignment with the seat of the middle bed assembly to form a portion of the generally horizontal sleeping surface.

29. The chair of claim 28, wherein the chair back abuts the seat and the seat abuts the leg support to form the generally horizontal sleeping surface.

30. The chair of claim 26, wherein a shelf is positioned behind the chair back such that the shelf is hidden when the chair back is in its generally upright back-supporting position and the shelf is visible and accessible when the chair back is in its generally horizontal position.

31. The chair of claim 26, wherein the chair back is mounted to the frame permitting the chair back to pivotably move to its generally upright back-supporting and generally horizontal positions.

32. A chair adapted to form a sitting surface and a sleeping surface comprising a frame, a chair back coupled to the frame and movable between generally upright and generally horizontal positions, a seat coupled the frame and movable away from the chair back, and a leg support coupled to the frame and positioned underneath the seat and movable out from under the seat when the seat is moved away from the chair back, the chair back moved from a generally upright position to a generally horizontal position, and the chair back, the seat and the leg support positioned in alignment and cooperating to form a generally horizontal sleeping surface with the chair back abutting the seat and the seat abutting the leg support, wherein a shelf is positioned behind the chair back such that the shelf is hidden when the chair back is in its generally upright position and the shelf is visible and accessible when the chair back is in its generally horizontal position.

33. The chair of claim 32 wherein the chair includes a lock coupled below the seat to the frame to releasably lock the seat adjacent the chair back to provide a sitting surface.

34. The chair of claim 33 wherein the lock is connected to a support frame below the seat, the lock including a ramp with a detent formed therein, the frame including a retainer having a roller which is releasably retained in the detent when the chair is in a locked position forming the sitting position.

35. A chair adapted to form a sleeping surface comprising a frame, a chair back coupled to the frame and movable between generally upright and horizontal positions, the chair back including a surface against which a back of a person can rest when the chair back is positioned in the generally upright position, the surface facing downwardly when the chair back is positioned in the generally horizontal position, and a seat coupled to the frame, the seat being movable away from the chair back, the chair back being movable to the generally horizontal position to cooperate with the seat to provide a sleeping surface, wherein the chair includes a lock coupled below the seat to the frame to releasably lock the seat adjacent the chair back to provide a sitting surface, and the lock is connected to a support frame below the seat, the lock including a ramp with a detent formed therein, the frame including a retainer having a roller which is releasably retained in the detent when the chair is in a locked position forming the sitting position.

36. The chair of claim 35, wherein the support frame supports the seat and is configured to move relative to the frame between a retracted position for the chair to provide the sitting surface and an extended position for the chair to provide the sleeping surface, and the ramp is coupled to the support frame for movement therewith.

37. The chair of claim 35, wherein the seat includes a middle bed assembly positioned beneath the seat and a lower bed assembly is positioned underneath the seat when the chair is positioned to form a sitting surface, the lower bed assembly being coupled to the middle bed assembly and movable away from the seat and the chair back, the lower bed assembly including a leg support movable upwardly when the lower bed assembly moves away from the seat such that the leg support is moved into alignment with the seat of the middle bed assembly to form a portion of the sleeping surface.

38. The chair of claim 37, wherein the chair back abuts the seat and the seat abuts the leg support to form the sleeping surface.

39. The chair of claim 35, wherein a shelf is positioned behind the chair back such that the shelf is hidden when the chair back is in an upright position and the shelf is visible and accessible when the chair back is in its generally horizontal position.

40. A chair adapted to form both a sitting surface and a sleeping surface comprising a frame, a chair back coupled to the frame and having an upright position and movable to a lowered position, the chair back including a surface against which a back of a person can rest when the chair back is positioned in the upright position, the surface facing downwardly when the chair back is positioned in the lowered position, and a seat coupled to the frame to cooperate with the chair back to provide a sitting surface in front of the chair back when the chair back is in the generally upright position, the seat being movable forwardly to cooperate with the chair back moved into the lowered position to form a sleeping surface, wherein the chair includes a lock coupled to a support frame and the frame to releaseably lock the seat adjacent the chair back to provide the sitting surface, and the lock includes a ramp with a detent formed therein, the frame including a retainer having a roller which is releasably retained in the detent when the chair is in a locked position forming the sitting position.

41. The chair of claim 40, wherein the support frame supports the seat and is configured to move relative to the frame between a retracted position for the chair to provide the sitting surface and an extended position for the chair to provide the sleeping surface, and the ramp is coupled to the support frame for movement therewith.

42. The chair of claim 40, wherein a shelf is positioned behind the chair back such that the shelf is hidden when the chair back is in its upright position and the shelf is visible and accessible when the chair back is in its lowered position.

43. The chair of claim 40, wherein the seat includes a middle bed assembly positioned beneath the seat and a lower bed assembly is positioned underneath the seat when the chair is positioned to form the sitting surface, the lower bed assembly being coupled to the middle bed assembly and movable away from the seat and the chair back, the lower bed assembly including a leg support movable upwardly when the lower bed assembly moves away from the seat such that the leg support is moved into alignment with the seat of the middle bed assembly to form a portion of the sleeping surface.

44. The chair of claim 43, wherein the chair back abuts the seat and the seat abuts the leg support to form the sleeping surface.

45. A chair adapted to form a sitting surface and a sleeping surface comprising a frame, a chair back coupled to the frame and movable from a generally upright back-supporting position to a generally horizontal position, a seat coupled the frame and movable away from the chair back so that when the chair back is moved to the generally horizontally position, the chair back and the seat are positioned in alignment and cooperate to form a generally horizontal sleeping surface, and a lock coupled to a support frame and the frame to releaseably lock the seat adjacent the chair back to provide a sitting surface, wherein the lock includes a ramp with a detent formed therein, the frame including a retainer having a roller which is releasably retained in the detent when the chair is in a locked position forming the sitting position.

46. The chair of claim 45, wherein the support frame supports the seat and is configured to move relative to the frame between a retracted position for the chair to provide the sitting surface and an extended position for the chair to provide the sleeping surface, and the ramp is coupled to the support frame for movement therewith.

47. A chair adapted to form a sitting surface and a sleeping surface comprising a frame, a chair back positioned in an upright position having a convex upper end and coupled to the frame, a seat having a concave end positioned under the chair back and coupled to the frame, the seat being movable away from the chair back and the chair back being movable to a generally horizontal position such that the convex upper end conformingly fits against the concave end of the seat to cooperate with the seat to provide a sleeping surface, and a lock coupled below the seat to the frame to releaseably lock the seat adjacent the chair back to provide a sitting surface.

48. The chair of claim 47 wherein the lock is connected to a support frame below the seat, the lock including a ramp with a detent formed therein, the frame including a retainer having a roller which is releasably retained in the detent when the chair is in a locked position forming the sitting position.

* * * * *